US009315357B2

(12) United States Patent
Souwand et al.

(10) Patent No.: US 9,315,357 B2
(45) Date of Patent: Apr. 19, 2016

(54) CABLE BUNDLING ASSEMBLY

(71) Applicant: Christie Lites Enterprises Canada Inc., Toronto (CA)

(72) Inventors: Dan Souwand, Toronto (CA); Ray Finkle, Roslin (CA)

(73) Assignee: CHRISTIE LITES ENTERPRISES CANADA INC., Toronto, ON ( * ) Notice: Subject to any disclaimer, the term of this patent is extended or adjusted under 35 U.S.C. 154(b) by 218 days.

(21) Appl. No.: 14/200,709

(22) Filed: Mar. 7, 2014

(65) Prior Publication Data

US 2015/0251872 A1 Sep. 10, 2015

(51) Int. Cl.

| | |
|---|---|
| ***B65B 13/02*** | (2006.01) |
| ***B65H 51/00*** | (2006.01) |
| ***B65H 51/14*** | (2006.01) |
| ***B65H 51/32*** | (2006.01) |
| ***B65H 54/76*** | (2006.01) |
| *B65B 13/18* | (2006.01) |
| *B65H 51/30* | (2006.01) |
| *B65B 35/46* | (2006.01) |
| *B65H 51/28* | (2006.01) |
| *B65H 51/015* | (2006.01) |

(52) U.S. Cl.

CPC ..... *B65H 51/14* (2013.01); *B65H 51/32* (2013.01); *B65H 54/76* (2013.01); *B65B 13/02* (2013.01); *B65B 13/183* (2013.01); *B65B 35/46* (2013.01); *B65H 51/015* (2013.01); *B65H 51/28* (2013.01); *B65H 51/30* (2013.01); *B65H 2551/152* (2013.01); *Y10T 29/53543* (2015.01)

(58) Field of Classification Search

CPC ..... B65B 13/00–13/345; B65B 35/30; B65B 35/36; B65B 35/40; B65B 35/405; B65B 35/44; B65B 35/46; B65H 51/015; B65H 51/14; B65H 51/18; B65H 51/30; B65H 51/32; B65H 51/38; Y10T 156/10; Y10T 156/1028; Y10T 156/103

USPC ..... 100/14, 18, 33 PB, 33 R; 156/184; 226/115

See application file for complete search history.

(56) References Cited

U.S. PATENT DOCUMENTS

| | | | |
|---|---|---|---|
| 4,421,227 | A | 12/1983 | Kornylak |
| 5,878,489 | A | 3/1999 | Shioda et al. |

FOREIGN PATENT DOCUMENTS

| | | |
|---|---|---|
| CA | 1044575 | 12/1978 |
| CA | 1328732 | 4/1994 |

*Primary Examiner* — Carson Gross
(74) *Attorney, Agent, or Firm* — Dimock Stratton LLP

(57) ABSTRACT

A cable bundling assembly and a method of operation is provided for bundling cables. The assembly has a vertical conveyor which is mounted to a frame for advancing cables. The conveyor is driven by a drive unit and has an entrance side and an exit side. At least one fastener is provided on the conveyor. When an end of a set of cables are releasably secured to the fastener, the cables advance upwardly on an entrance side of the conveyor and downwardly on an exit side of the conveyor as the conveyor is driven by the drive unit. An operator control configured to activate the drive unit is provided. When the operator control activates the drive unit to advance the conveyor, the cables are advanced along the vertical conveyor on a substantially vertical axis and the cables advance from the entrance side of the vertical conveyor to the exit side of the vertical conveyor.

18 Claims, 5 Drawing Sheets

CABLE BUNDLING ASSEMBLY

TECHNICAL FIELD

The present disclosure generally relates to cable bundling assemblies for bundling cables.

TECHNICAL BACKGROUND

Various assemblies may be used for bundling cords, rope, or cables. In the entertainment industry, for example, it is common for long lengths of cable to be used for interconnecting audio/visual components. However, after the cables are unloaded or unwound, it can take time, effort and manual manipulation to wind or load a plurality of cables back into a storage unit like a crate, a case or a box.

To bundle cables, operators lay the plurality of cables out on a large flat surface and manually position the cables so that they can be taped, tied, or otherwise bundled together before loading it into a storage unit. However, this process can be tedious and time-consuming. If the cables are long, a lot of space is required to lay the cables out for taping and tying into a bundle. Also, oftentimes multiple individuals are needed to perform the above method.

BRIEF DESCRIPTION OF THE DRAWINGS

In drawings which illustrate by way of example only a preferred embodiment,

FIG. 2 is a side cross-sectional view of the cable bundling assembly shown in

FIG. 1.

DETAILED DESCRIPTION

Figure 1:
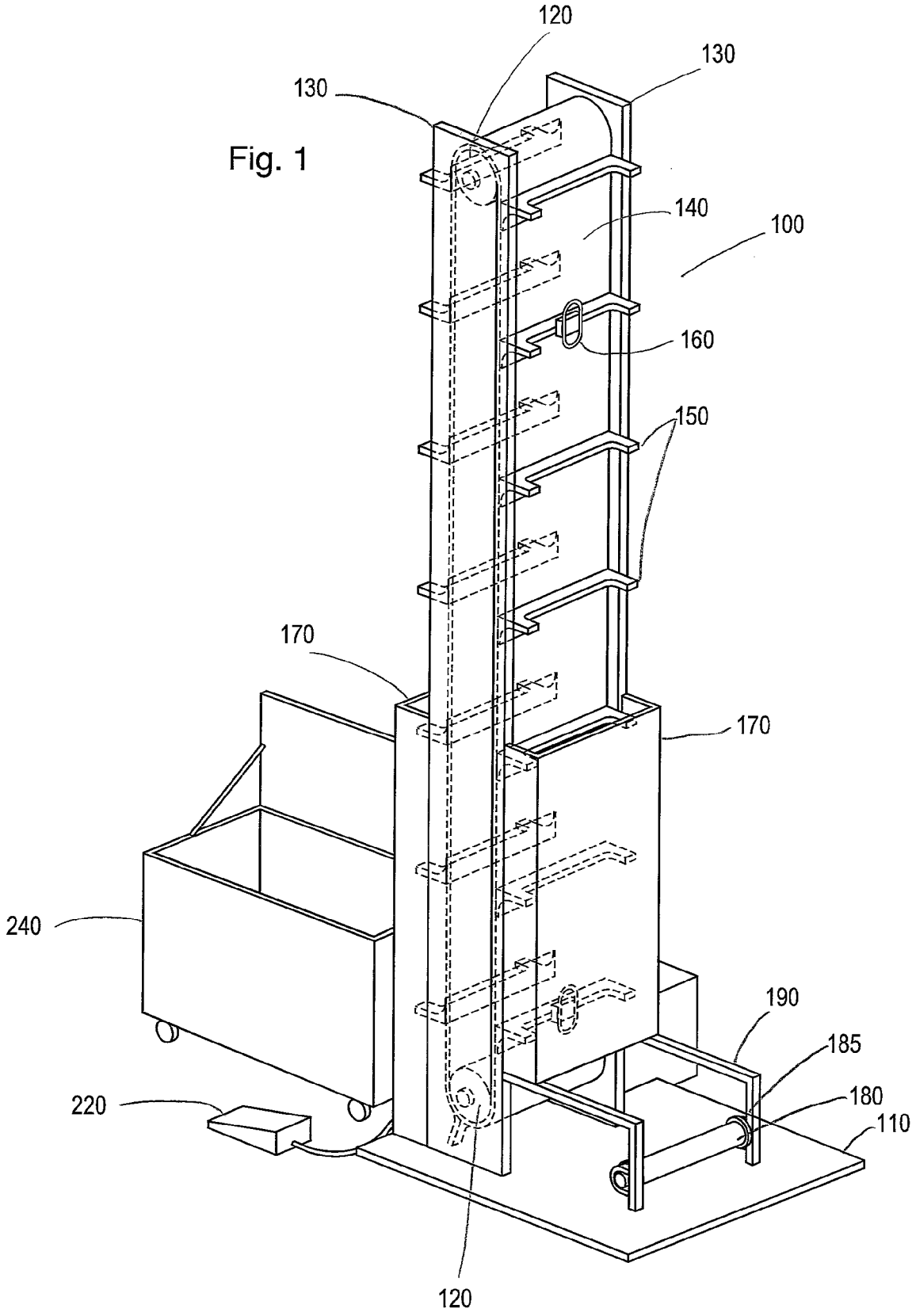
FIG. 1 is a perspective view of an embodiment of a cable bundling assembly.

There is therefore provided a cable bundling assembly for winding lengths of cable, rope or cord. There is also provided a method for operating the cable bundling assembly.

In one aspect, the cable bundling assembling comprises: a frame; a vertical conveyor mounted to the frame for advancing the plurality of cables, the vertical conveyor having a first side and a second side; at least one fastener mounted to the conveyor for releasably securing the plurality of cables to the vertical conveyor; a drive unit configured to move the vertical conveyor relative to the frame; and an operator control configured to activate the drive unit when the operator control is activated; whereby when the plurality of cables are releasably secured to one of the at least one fasteners, and when the operator control activates the drive unit to advance the vertical conveyor, the plurality of cables advance along the vertical conveyor on a substantially vertical axis and wherein the plurality of cables advance from the first side of the vertical conveyor to the second side of the vertical conveyor.

In another aspect, the cable bundling assembly further comprises at least one guide mounted to the frame and vertically spaced apart from a floor, whereby the guide steers the plurality of cables as they are being advanced along the vertical conveyor.

In yet another aspect, the guide comprises at least one roller.

In a further aspect, the at least one roller comprises flanged portions proximate the ends of the rollers to constrain horizontal movement of the plurality of cables as they are being advanced.

In yet a further aspect, the at least one guide is adjustable to modify a height and a horizontal distance relative to the vertical conveyor.

In another aspect, the cable bundling assembly further comprises a plurality of spacers disposed on the vertical conveyor, the plurality of spacers being disposed along a periphery of the vertical conveyor, whereby as the plurality of cables are advanced along the vertical conveyor, the plurality of cables are in friction contact with the spacers.

In yet another aspect, each spacer is an elongate ridge which is substantially perpendicular to a direction of movement of the vertical conveyor.

In a further aspect, the elongate ridge of each spacer comprises raised portions proximate a pair of ends of the elongate ridge for constraining lateral movement of the cables.

In yet a further aspect, the drive unit comprises a motor and a variable frequency drive.

In another aspect, the operator control comprises a pedal.

In yet another aspect, the cable bundling assembly further comprises a safety shield mounted to a lower portion of the frame on one or both of the first and second sides of the vertical conveyor.

In a further aspect, the cable bundling assembly further comprises a storage unit positioned at a base of the exit side of the vertical conveyor for receiving the plurality of cables.

In yet a further aspect, the at least one fastener comprises a clip, a clasp, or a tie.

In another aspect, the at least one fastener are mountable at a plurality of locations along the vertical conveyor.

In yet another aspect, the vertical conveyor advances upwardly on the first side of the conveyor and downwardly on the second side of the conveyor.

In one aspect of the method for operating the cable bundling assembly comprising a frame, a vertical conveyor mounted to the frame for advancing the plurality of cables, the vertical conveyor having a first side and a second side, at least one fastener mounted to the conveyor for releasably securing the plurality of cables to the vertical conveyor, a drive unit configured to move the vertical conveyor relative to the frame; and an operator control configured to activate the drive unit when the operator control is activated, whereby when the plurality of cables are releasably secured to one of the at least one fastener, and when the operator control activates the drive unit to advance the vertical conveyor, the plurality of cables advance along the vertical conveyor on a substantially vertical axis and wherein the plurality of cables advance from the first side of the vertical conveyor to the second side of the vertical conveyor, the method comprises the steps of: wrapping tape around a first end of the plurality of cables to bundle the plurality of cables; securing the first end of the plurality of cables to one of the at least one fasteners located on a first side of the vertical conveyor; advancing the plurality of cables along the vertical conveyor by a predetermined distance and wrapping tape around the plurality of cables at a position along the plurality of cables that is spaced apart from where the plurality of cables was previously taped by about the predetermined distance, and repeating the step of advancing the plurality of cables and wrapping tape around the plurality of cables until the plurality of cables is taped at predetermined intervals along its entire length.

In another aspect, the method comprises: when the first end of the plurality of cables is proximate a storage unit positioned at a base of the second side of the vertical conveyor, disconnecting the first end of the plurality of cables from the fastener; and when the second end of the plurality of cables is proximate the storage unit, disconnecting the second end of the plurality of cables from the fastener.

FIG. 1 is a perspective view of an embodiment of a cable bundling assembly. In this figure, a cable bundling assembly 100, comprising a frame 110 to support a vertical conveyor for advancing a plurality of cables (not shown) along the height of the cable bundling assembly 100. In this embodiment, the vertical conveyor comprises a pair of side walls 130 with a plurality of rollers 120 rotatably secured there between. In this embodiment, a belt 140 is wound around the rollers 120 such that when the rollers rotate, the belt 140 advances relative to the rollers 120 which rotate about a fixed axis. The belt 140 forms a periphery of the vertical conveyor which assists in advancing the cables 200 along the conveyor.

At least one of the rollers 120 is driven by a drive unit (not shown). In this embodiment, the upper roller is driven by said drive unit. The drive unit may comprise a motor, such as an electric or hydraulic motor. A drive control unit (not shown), such as a variable frequency drive (VFD), is provided to control both the speed and direction of the drive unit, thus allowing the conveyor to move in clockwise and counter-clockwise directions at varying speeds. The drive control unit is controlled by signals from an operator of the cable bundling assembly 100. Signals can be triggered by an operator control 220 in electrical communication with the drive control unit. The operator control 220 is a physical device manipulated by the operator of the assembly 100 to initiate or modulate the signals to the drive control unit. In some examples, the operator control 220 can be a switch, pedal, toggle, handle, or wheel control. In the example shown in FIG. 1, the operator control 220 is a foot pedal, which frees the operator's hands. The operator control 220 may be provided with means for controlling the speed of conveyor movement. For example, in the embodiment shown in the figures, an operator varies the speed of the conveyor by varying the amount of force applied to the operator control 220. In this way, the operator is provided with finer control over the speed at which the cables 200 are advanced along the conveyor. Alternatively, the operator control 220 provides an "on" (e.g., when the pedal is depressed) and an "off" (e.g., when the pedal is released) mode for activation of the conveyor without the ability to vary the speed.

Figure 2:
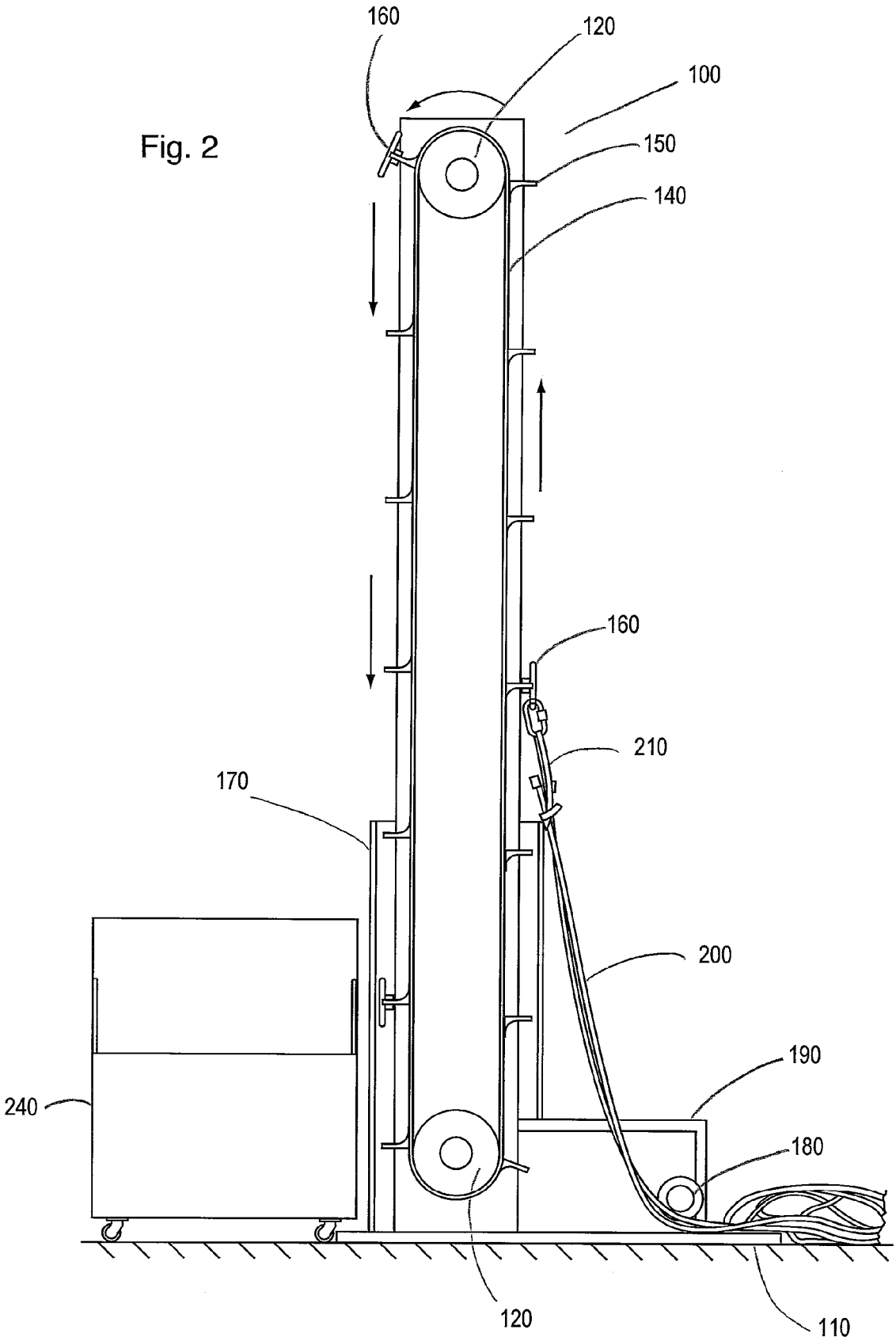
Figure 3:
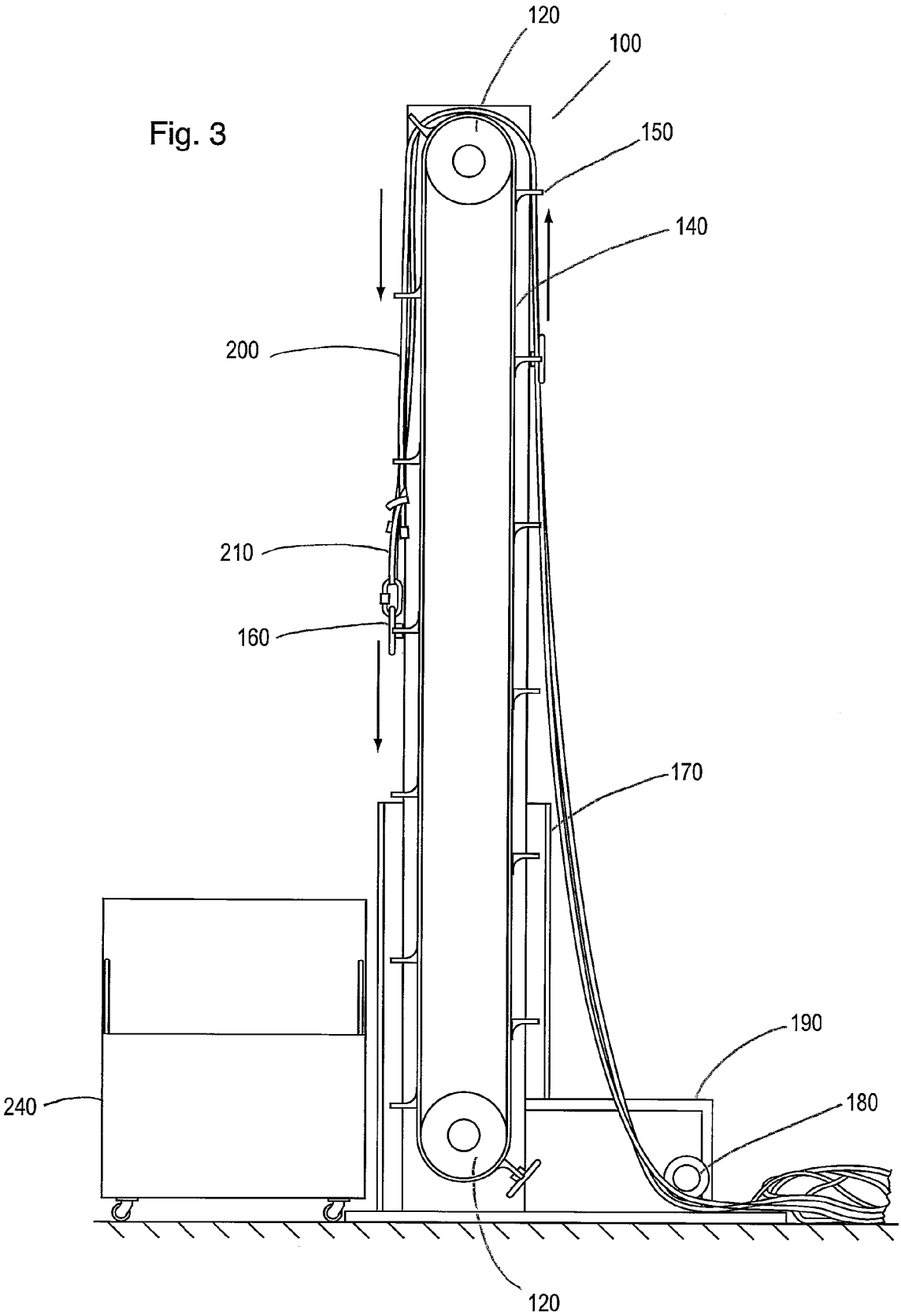
FIG. 3 is a further side cross-sectional view of the cable bundling assembly shown in FIGS. 1 and 2.
Figure 4:
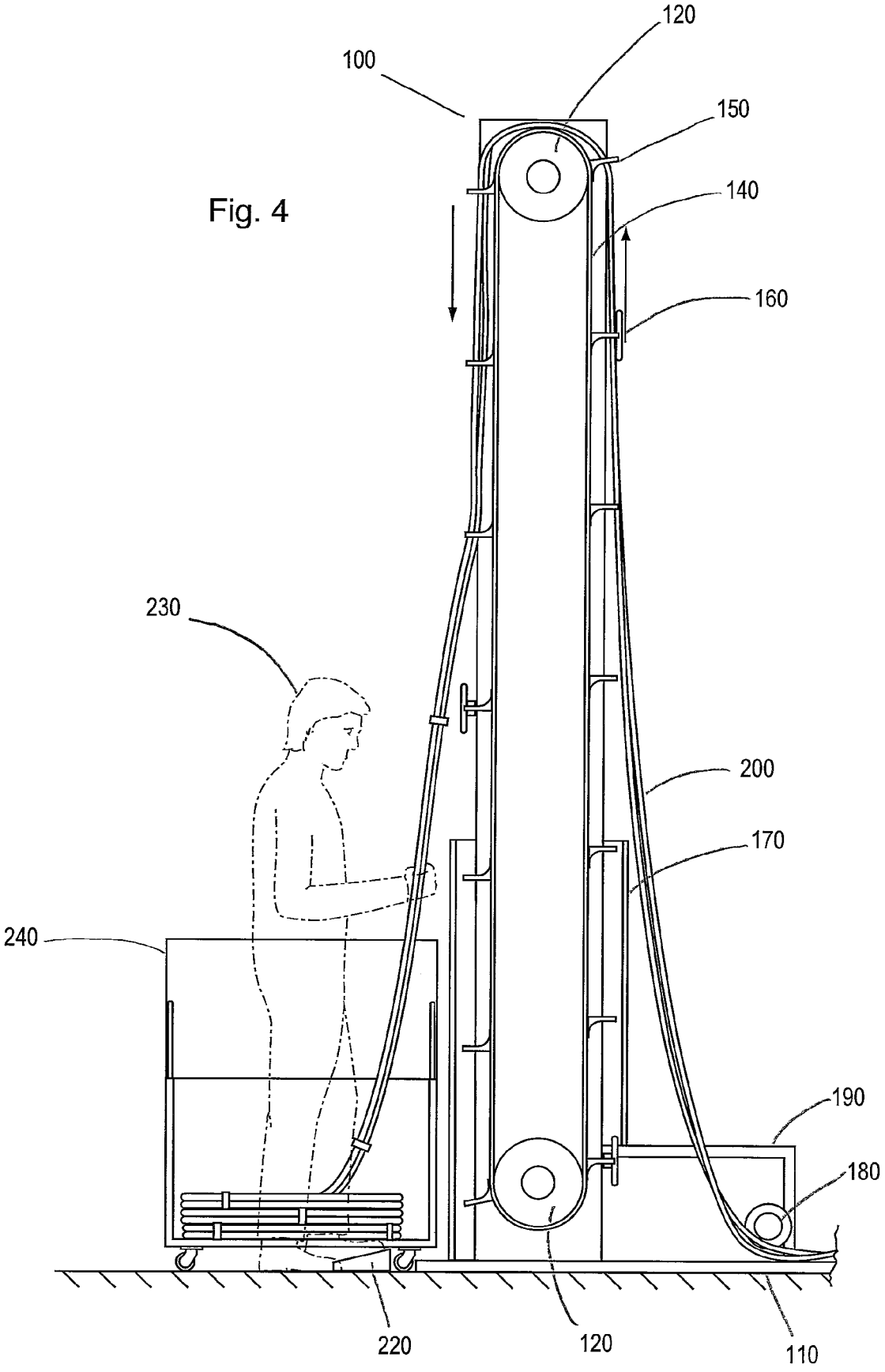
FIG. 4 is yet a further side cross-sectional view of the cable bundling assembly shown in FIGS. 1, 2, and 3.

In the embodiments shown in FIGS. 2 to 4, the vertical conveyor advances in the direction indicated in the figures when the operator control is activated. In one embodiment, an emergency stop control is provided (not shown) such that the drive unit may be deactivated even if the operator control 220 is providing a signal to activate the drive unit. The emergency stop control is a safety feature provided in the event the operator control 220 is unintentionally activated or if there is a malfunction in the operator control 220, the drive control unit, or the drive unit. The emergency stop control may be provided in a place that is accessible to the operator, whether they are on the entrance side or exit (or second) side of the assembly. For example, emergency stop control may be provided on one of the side walls at a height that is readily accessible by an operator of average height.

In an embodiment, assembly 100 comprises one or more shields 170 to protect an operator from injury by shielding the moving parts of the assembly from the operator. In the embodiment shown in FIG. 1, a shield 170 is provided on both an entrance (or first) side and an exit side of the assembly 100. By providing shield 170, an operator's hands or clothing are less likely to get caught in the moving parts of the assembly 100. As can be seen in FIG. 1, the one or more shields 170 go part way up the assembly leaving part of the vertical conveyor exposed. At least part of the conveyor must be accessible to the operator so that cables can be secured and unsecured from the conveyor. Accordingly, the one or more shields 170 is mounted such that the lower portion of the vertical conveyor is inaccessible, but only up to a height such that a part of the conveyor for securing and unsecuring cables remains accessible to the operator.

In an embodiment, assembly 100 comprises a guide roller 180 on the entrance side which guides cables 170 and prevents cable tangle as the cables 170 are advanced along the vertical conveyor. In one embodiment, the guide roller 180 is height adjustable and is rotatably mounted to sub-frame 190. In a further embodiment, the guide roller 180 is adjustable to vary the distance between the guide roller 180 and the vertical conveyor. In still a further embodiment, sub-frame 190 is fixably mounted to frame 110. The guide roller 180 shown in FIG. 1 comprises a pair of flanges 185 proximate the ends of the guide roller 180 to constrain lateral movement of the cables and to prevent cables from coming off the guide rollers and into other parts of the assembly. As cables 200 are secured to the vertical conveyor and advanced along the height of the cable, the cables 200 (which are moving in an upward direction on the entrance side of the assembly) are biased against the guide roller 180. The upward movement of the cables combined with the biasing of the guide rollers reduce the amount of manual intervention needed to align the cables 200 for bundling.

In an embodiment, the vertical conveyor is provided with a plurality of spacers 150 which are spaced apart along the length of belt 140. In the embodiment shown in FIGS. 1-5, spacers 150 are roughly the width of the belt 140 and form an elongate rib. The ends of the elongate rib may have raised portions for constraining lateral movement such that cables are prevented from coming off the vertical conveyor while the cable is being advanced. A further function of spacers 150 is to keep the cables spaced apart from the vertical conveyor. By providing space between the cables and the vertical conveyor, the cables are easier for an operator to access and handle. Spacers 150 may be provided with a friction surface such that as the vertical conveyor is advanced, the friction surface of the spacer 150 constrains the cables 200 from lateral movement and reduces the amount of relative movement between the cables 200 and the spacers 150.

The vertical conveyor is provided with at least one fastener 160 for releasably securing one or more cables thereto. Fasteners 160 may be a clip, a clasp, a tie, or some other means for securing an object to the conveyor. In FIG. 2, a first end of the cables 200 is shown tied together with a rope or sling 210. The first end of the cables 200 are fed underneath the guide roller 180 and are then secured to one of the fasteners 160 by securing the sling or rope 210 to the fastener 160. Alternatively, the fastener 160 comprises a means for securing and bundling a first end of the cables 200 such that a sling 210 is not needed to secure the cables to the vertical conveyor. In this further embodiment, cables 200 are secured directly to fastener 160 without the use of some other apparatus, such as a sling 210.

In FIG. 2, cables 200 are secured to fastener 160 on the entrance side of the assembly 100. The arrows illustrate the direction of advancement of the vertical conveyor in a preferred embodiment. When secured to the vertical conveyor as illustrated, the cables 200 are advanced along the height of the assembly 100 and advance up the vertical conveyor on the entrance side of the assembly and down the vertical conveyor on the exit side of the assembly.

In an embodiment, the assembly 100 comprises a plurality of fasteners. In this embodiment, the fasteners are spaced apart such that the distance between a pair of fasteners is about a multiple of a length of a plurality of cables 200 that would be used on the assembly 100. For example, in an application where the cables being bundled are about 50 feet, a pair of fasteners is spaced apart at a distance of some multiple of 50, such as about 5 feet, about 10 feet, or about 25 feet. That way, if the first end of the cables is secured to one of the fasteners, the second end of the cables may be secured to a second one of the fasteners with minimal slack between the first and second ends of the cables.

In an embodiment where more than one fastener 160 is provided, the distance between any two fasteners 160 may be varied to accommodate cables of different lengths. In one embodiment, fastener 160 is removable, and can be mounted at different positions along the periphery of the conveyor.

Turning to FIG. 3, as the cables 200 are advanced to the top of the assembly 100, the cables 200 are advanced over the top of the vertical conveyor towards the exit side of the assembly 100. In one method of operation, an operator temporarily stops conveyor advancement so that the cables 200 can be disconnected from the fastener 160. Once disconnected, the operator 230 (shown in FIG. 4) manually guides the cables 200 into a storage unit 240 (e.g., a crate, a case, or a box) where the cables (now bundled) are neatly wound or coiled for storage or transport. In a preferred method, the operator advances the cables 200 such that when cables 200 are disconnected from fastener 160, the cables remain stationary and do not fall back over the top of the vertical conveyor towards the entrance side of the assembly 100. If spacers 150 are provided with a friction surface for contacting the cables, the one or more spacers 150 that are proximate the top of the vertical conveyor may also constrain vertical movement due to the operation of gravity such that the cables are less likely to fall back towards the entrance side of the vertical conveyor.

Figure 5:
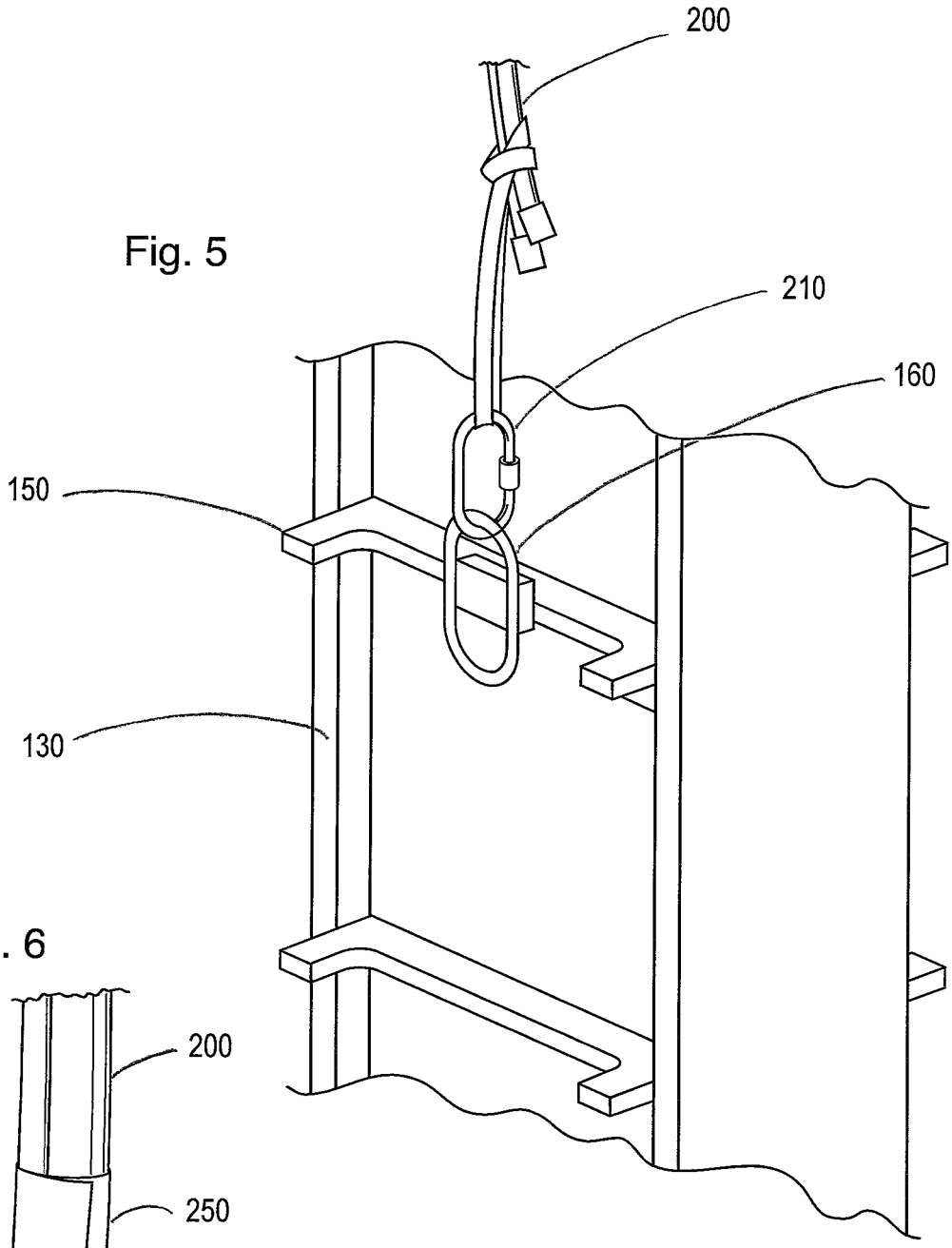
FIG. 5 is a partial view of the exit side of the cable bundling assembly shown in FIG. 1.

FIG. 5 illustrates a partial view of a part of the assembly of FIG. 3.

Figure 6:
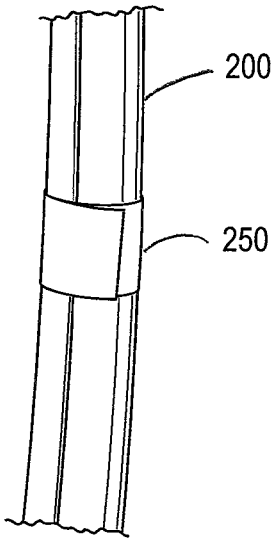
FIG. 6 is a view of a plurality of cables bundled together using tape.

In one method of operation of the assembly 100, tape is applied to secure the cables 200 into a bundle at various points along the cables' length. Bundling cables in this way using means such as tape, rope, or ties, make them easier to store and transport. In this method, after a first end of the cables 200 has been secured to fastener 160, tape 250 (shown in FIG. 6) may be applied to the cables 200. The operator then advances the cables by advancing the vertical conveyor, stopping at predetermined intervals to apply tape 250 to a location further along the length of the cables 200. Applying tape 250 throughout the length of the cables 200 ensures that the cables remain neatly bundled for storage or transport. The process of advancing the cables and applying tape is repeated until the operator reaches the second end of the cables 200 such that the cables 200 are bundled together using tape or the like at various locations along the entire length of the cables 200.

Once the cables 200 have been advanced such that the second end of the cables 200 are proximate the vertical conveyor (and in the embodiment with shields 170, above the shields 170), the second end of the cables 200 are secured to one of the at least one fasteners 160. That way, even as the second end of the cables 200 nears the top of the assembly, the cables 200 will not fall off of the vertical conveyor. Once the second end of the cables 200 has been secured to the vertical conveyor by fastener 160, the operator continues to advance the cables, periodically stopping to apply tape, as needed. When the second end of the cables 200 are proximate the storage unit 240, the operator disconnects the second end of the cables 200 from the fastener 160. The remaining length of the cables 200 are then dropped or placed into the storage unit 240 by the operator.

On the exit side of the conveyor, an operator disconnects the cables 200 from the fastener 160 once the first end of the cables 200 is proximate a storage unit 240. At this step, the second end of the cables 200 may or may not be secured to fastener 160 on the entrance side of the vertical conveyor. As the cables 200 are advanced further, cables 200 are guided by an operator into the storage unit 240.

The cables 200 are then advanced until the second end of the cables 200 are reachable by the operator on the exit side of the assembly. The operator then disconnects the second end of the cables 200 from the fastener 160 and guides the remaining length of the cables 200 into the storage unit 240.

In contrast to the cable bundling method of laying out the cables on the ground, use of the assembly 100 to perform the above-mentioned method saves time as it limits the amount of walking needed to arrange the cables on the ground and apply tape to bundle the cables together. Also, because of the relatively small footprint of the assembly 100, a single operator can efficiently perform the method used to operate the assembly 100 because the assembly 100 is arranging the cables in substantially parallel orientation so that the cables can be bundled by tape more readily. The assembly 100 and the method of operating the assembly makes use of gravity in combination various features of the assembly 100 to allow an operator to more easily and efficiently arrange the cables for bundling and storage.

Various embodiments having been thus described in detail by way of example, it will be apparent to those skilled in the art that variations and modifications may be made and still achieve the desired outcome. The embodiments described herein include all such variations and modifications as fall within the scope of the appended claims.

What is claimed is:

1. A cable bundling assembly for bundling a plurality of cables, the assembly comprising:

a frame;

a vertical conveyor mounted to the frame for advancing the plurality of cables, the vertical conveyor having a first side and a second side;

at least one fastener mounted to the conveyor for releasably securing the plurality of cables to the vertical conveyor;

a drive unit configured to move the vertical conveyor relative to the frame; and an operator control configured to activate the drive unit when the operator control is activated;

whereby when the plurality of cables are releasably secured to one of the at least one fasteners, and when the operator control activates the drive unit to advance the vertical conveyor, the plurality of cables advance along the vertical conveyor on a substantially vertical axis and wherein the plurality of cables advance from the first side of the vertical conveyor to the second side of the vertical conveyor.

2. The cable bundling assembly of claim 1, further comprising at least one guide mounted to the frame and vertically spaced apart from a floor, whereby the guide steers the plurality of cables as they are being advanced along the vertical conveyor.

3. The cable bundling assembly of claim 2, wherein the guide comprises at least one roller.

4. The cable bundling assembly of claim 3, wherein the at least one roller comprises flanged portions proximate the ends of the rollers to constrain horizontal movement of the plurality of cables as they are being advanced.

5. The cable bundling assembly of claim 2, wherein the at least one guide is adjustable to modify a height and a horizontal distance relative to the vertical conveyor.

6. The cable bundling assembly of claim 1, further comprising a plurality of spacers disposed on the vertical conveyor, the plurality of spacers being disposed along a periphery of the vertical conveyor, whereby as the plurality of cables are advanced along the vertical conveyor, the plurality of cables are in friction contact with the spacers.

7. The cable bundling assembly of claim 6, wherein each spacer is an elongate ridge which is substantially perpendicular to a direction of movement of the vertical conveyor.

8. The cable bundling assembly of claim 7, wherein the elongate ridge of each spacer comprises raised portions proximate a pair of ends of the elongate ridge for constraining lateral movement of the cables.

9. The cable bundling assembly of claim 1, wherein the drive unit comprises a motor and a variable frequency drive.

10. The cable bundling assembly of claim 1, wherein the operator control comprises a pedal.

11. The cable bundling assembly of claim 1, further comprising a safety shield mounted to a lower portion of the frame on one or both of the first and second sides of the vertical conveyor.

12. The cable bundling assembly of claim 1, further comprising a storage unit positioned at a base of the second side of the vertical conveyor for receiving the plurality of cables.

13. The cable bundling assembly of claim 1, wherein the at least one fastener comprises a clip, a clasp, or a tie.

14. The cable bundling assembly of claim 1, wherein the at least one fastener are mountable at a plurality of locations along the vertical conveyor.

15. The cable bundling assembly of claim 1, wherein the vertical conveyor advances upwardly on the first side of the conveyor and downwardly on the second side of the conveyor.

16. A method of bundling a plurality of cables for use with a cable bundling assembly, the assembly comprising a frame, a vertical conveyor mounted to the frame for advancing the plurality of cables, the vertical conveyor having a first side and a second side, at least one fastener mounted to the conveyor for releasably securing the plurality of cables to the vertical conveyor, a drive unit configured to move the vertical conveyor relative to the frame; and an operator control configured to activate the drive unit when the operator control is activated, whereby when the plurality of cables are releasably secured to one of the at least one fastener, and when the operator control activates the drive unit to advance the vertical conveyor, the plurality of cables advance along the vertical conveyor on a substantially vertical axis and wherein the plurality of cables advance from the first side of the vertical conveyor to the second side of the vertical conveyor, the method comprising the steps of:

wrapping tape around a first end of the plurality of cables to bundle the plurality of cables;

securing the first end of the plurality of cables to one of the at least one fasteners located on a first side of the vertical conveyor;

advancing the plurality of cables along the vertical conveyor by a predetermined distance and wrapping tape around the plurality of cables at a position along the plurality of cables that is spaced apart from where the plurality of cables was previously taped by about the predetermined distance, and repeating the step of advancing the plurality of cables and wrapping tape around the plurality of cables until the plurality of cables is taped at predetermined intervals along its entire length.

17. The method of claim 16 above wherein the assembly further comprises a storage unit positioned at a base of the second side of the vertical conveyor for receiving the plurality of cables, the method further comprising the step of:

when the plurality of cables has been advanced such that a second end of the plurality of cables is proximate the first side of the vertical conveyor, securing the second end of the plurality of cables to one of the at least one fasteners.

18. The method of claim 17, further comprising the steps of:

when the first end of the plurality of cables is proximate a storage unit positioned at a base of the second side of the vertical conveyor, disconnecting the first end of the plurality of cables from the fastener; and when the second end of the plurality of cables is proximate the storage unit, disconnecting the second end of the plurality of cables from the fastener.

* * * * *